US010239183B2

(12) United States Patent
Sung et al.

(10) Patent No.: US 10,239,183 B2
(45) Date of Patent: Mar. 26, 2019

(54) CHEMICAL MECHANICAL POLISHING PAD AND METHOD FOR MANUFACTURING THE SAME

(71) Applicants: Chien-Hung Sung, Taipei (TW); Kuan-Ting Lin, Taipei (TW)

(72) Inventors: Chien-Hung Sung, Taipei (TW); Kuan-Ting Lin, Taipei (TW)

(73) Assignee: SLH TECHNOLOGY CO., LTD., Taipei (TW)

( * ) Notice: Subject to any disclaimer, the term of this patent is extended or adjusted under 35 U.S.C. 154(b) by 32 days.

(21) Appl. No.: 15/422,125

(22) Filed: Feb. 1, 2017

(65) Prior Publication Data

US 2018/0043499 A1 Feb. 15, 2018

(30) Foreign Application Priority Data

Aug. 11, 2016 (TW) ..... 105125562 A

(51) Int. Cl.
*B24B 37/26* (2012.01)
*B24D 18/00* (2006.01)
*B24B 37/22* (2012.01)

(52) U.S. Cl.
CPC ..... *B24B 37/26* (2013.01); *B24B 37/22* (2013.01); *B24D 18/00* (2013.01)

(58) Field of Classification Search
CPC ..... B24B 37/26; B24D 18/00
USPC ..... 451/526–550
See application file for complete search history.

(56) References Cited

U.S. PATENT DOCUMENTS 5,177,908 A * 1/1993 Tuttle ..... B24B 7/228 451/287
5,882,251 A * 3/1999 Berman ..... B24B 37/26 451/285
5,921,855 A * 7/1999 Osterheld ..... B24B 37/26 451/527
6,238,271 B1 * 5/2001 Cesna ..... B24B 37/26 451/41

(Continued)

FOREIGN PATENT DOCUMENTS

TW 200510124 A 3/2005
TW 201529652 A 8/2015

OTHER PUBLICATIONS

Search Report appended to an Office Action, which was issued to Taiwanese counterpart application No. 105125562 by the TIPO on Feb. 16, 2017, with an English translation thereof (2 pages).

(Continued)

*Primary Examiner* — George Nguyen
(74) *Attorney, Agent, or Firm* — Hamre, Schumann, Mueller & Larson, P.C.

(57) ABSTRACT

A chemical mechanical polishing pad includes a base portion and a polishing portion. The base portion has opposite first and second side surfaces. The polishing portion extends from the first side surface away from the second side surface, has a polishing surface facing away from the base portion, and has at least one trench formed in the polishing surface. Each of the trenches has an opening defined by the polishing surface. A horizontal width of the opening of each of the trenches is equal to or smaller than that of the remaining portion of the trench. The chemical mechanical polishing pad is made by laminating a plurality of polymer layers.

6 Claims, 2 Drawing Sheets

(56) References Cited

U.S. PATENT DOCUMENTS 6,729,950 B2 * 5/2004 Park ..... B24B 37/26 257/E21.23
2002/0068516 A1 * 6/2002 Chen ..... B24B 37/16 451/285
2002/0098789 A1 * 7/2002 Burke ..... B24B 37/24 451/526
2003/0220061 A1 * 11/2003 Prasad ..... B24B 37/24 451/526
2004/0072522 A1 * 4/2004 Petroski ..... B24B 37/22 451/533
2005/0032469 A1 * 2/2005 Duescher ..... B24D 11/001 451/548
2005/0118939 A1 * 6/2005 Duescher ..... B24D 11/00 451/527
2006/0046626 A1 * 3/2006 Renteln ..... B24B 37/26 451/527
2006/0079159 A1 * 4/2006 Naujok ..... B24B 37/245 451/285
2008/0064302 A1 * 3/2008 Fujitani ..... B24B 37/26 451/41
2009/0011679 A1 * 1/2009 Bajaj ..... B24B 37/26 451/5
2010/0009601 A1 * 1/2010 Wang ..... B24B 37/26 451/36
2010/0056031 A1 * 3/2010 Chiu ..... B24B 37/26 451/527
2011/0183579 A1 * 7/2011 Newelll ..... B24B 37/26 451/28
2012/0083191 A1 * 4/2012 Allison ..... B24B 37/013 451/526
2013/0035021 A1 * 2/2013 Doura ..... C08G 18/2835 451/41
2014/0141704 A1 * 5/2014 Takeuchi ..... B24B 37/26 451/529
2014/0170943 A1 * 6/2014 Takeuchi ..... B24B 37/22 451/527
2014/0170944 A1 * 6/2014 Moudry ..... B24B 37/16 451/540
2015/0079886 A1 * 3/2015 Schutte ..... B24B 37/26 451/527
2015/0126099 A1 * 5/2015 Krishnan ..... B33Y 10/00 451/529

OTHER PUBLICATIONS

The Search Report appended to an Office Action, which was issued to Chinese counterpart application No. 201610885316.2 by the CNIPA, dated Oct. 19, 2018, and corresponding English translation.

* cited by examiner

CHEMICAL MECHANICAL POLISHING PAD AND METHOD FOR MANUFACTURING THE SAME

CROSS-REFERENCE TO RELATED APPLICATION

This application claims priority of Taiwanese Patent Application No. 105125562, filed on Aug. 11, 2016.

FIELD

The disclosure relates to a polishing pad, and more particular to a chemical mechanical polishing pad and a method for manufacturing the same.

BACKGROUND

Chemical mechanical polishing is achieved by retaining slurry in trenches of a polishing pad to simultaneously performing chemical and mechanical polishing of a silicon wafer to planarize the same.

During the process of chemical mechanical polishing, the polishing pad must retain a certain amount of slurry to achieve effectively polishing effects. In addition, debris generated during the process should be removed from the wafer surface to avoid scratching the wafer surface.

SUMMARY

Therefore, an object of the present disclosure is to provide a chemical mechanical polishing pad and a method for manufacturing the same.

According to the present disclosure, a chemical mechanical polishing pad includes a base portion and a polishing portion.

The base portion has opposite first and second side surfaces. The polishing portion extends from the first side surface of the base portion away from the second side surface, has a polishing surface facing away from the base portion, and at least one trench formed in the polishing surface. The trench has an opening defined by the polishing surface of the polishing portion. A horizontal width of the opening of the trench is equal to or smaller than that of the remaining portion of the trench.

According to the present disclosure, a method for manufacturing the above described chemical mechanical polishing pad includes laminating a plurality of polymer layers by additive manufacturing technique.

BRIEF DESCRIPTION OF THE DRAWINGS

Other features and advantages of the present disclosure will become apparent in the following detailed description of the embodiments with reference to the accompanying drawings, of which.

DETAILED DESCRIPTION

Figure 1:
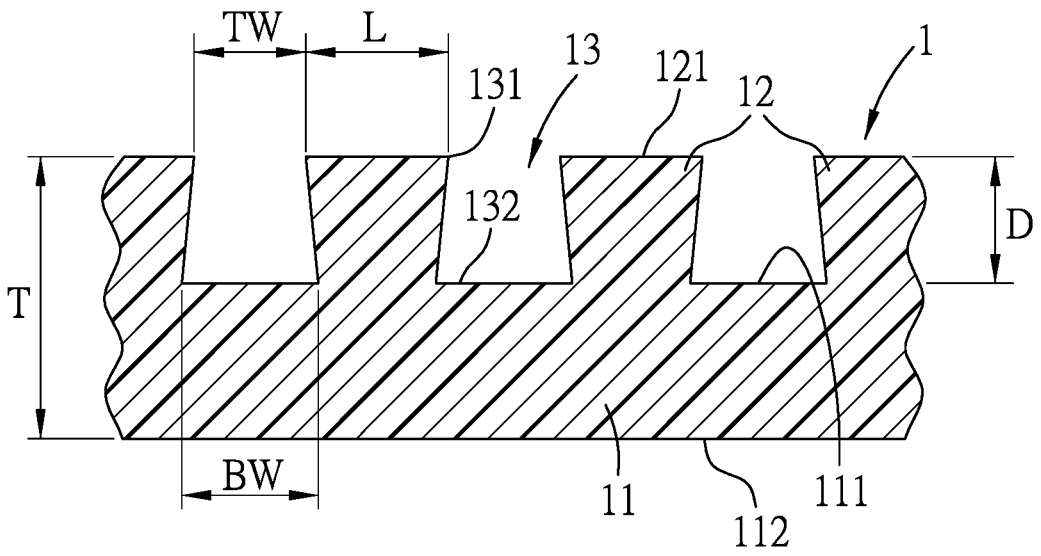
FIG. 1 is a fragmentary sectional view of a first embodiment of a chemical mechanical polishing pad according to the present disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIG. 1, a first embodiment of a chemical mechanical polishing pad 1 according to the present disclosure includes a base portion 11 and a polishing portion 12.

The base portion 11 has opposite first and second side surfaces 111, 112. The polishing portion 12 extends from the first side surface 111 of the base portion 11 away from the second side surface 112, has a polishing surface 121 facing away from the base portion 11, and has a trench unit that is continuous or non-continuous. The non-continuous trench unit may include a plurality of annular trenches 13 that are concentric. The continuous trench unit may be configured as a spiral or grid trench unit including a plurality of trenches 13 that are communicated with each other. In certain embodiments, the non-continuous trench unit may include a plurality of trenches 13 to forma grid pattern at a central portion thereof, and an annular pattern surrounding the grid pattern. Each of the trenches 13 has an opening 131 defined by the polishing surface 121 of the polishing portion 12. A horizontal width (TW) of the opening 131 of each of the trenches 13 is equal to or smaller than that of the remaining portion of the trench 13. In this embodiment, the horizontal width (TW) of the opening 131 of each of the trenches 13 is smaller than that of the remaining portion of the trench 13 such that the cross section of each of the trenches 13 is trapezoid shaped. In other words, each of the tranches 13 terminates at the first side surface 111 of the base portion 11, and is tapered from the first side surface 111 of the base portion 11 to the polishing surface 121 of the polishing portion 12. Such tapering design allows the trenches 13 to accommodate more slurry, thereby increasing polishing efficiency of the chemical mechanical polishing pad 1. Furthermore, since the horizontal width (TW) of the opening 131 of each of the trenches 13 is smaller than that of the remaining portion of the trench 13, debris generated during the polishing process is more likely to be retained in the trenches 13, thereby reducing the possibility of wafer scratch.

In this embodiment, the chemical mechanical polishing pad 1 has a thickness (T) ranging from 1.2 mm to 3 mm. Each of the trenches 13 has a depth (D) ranging from 0.2 mm to 2.5 mm. The horizontal width (TW) of the opening 131 of each of the trenches 13 ranges from 0.5 mm to 15 mm. A bottom side 132 of each of the trenches 13 has a width (BW) ranging from 0.5 mm to 16 mm. The horizontal distance (L) between the openings 131 of two adjacent ones of the trenches 13 ranges from 0.2 mm to 20 mm. Each of the above described dimensions can be changed according to practical requirements.

Figure 2:
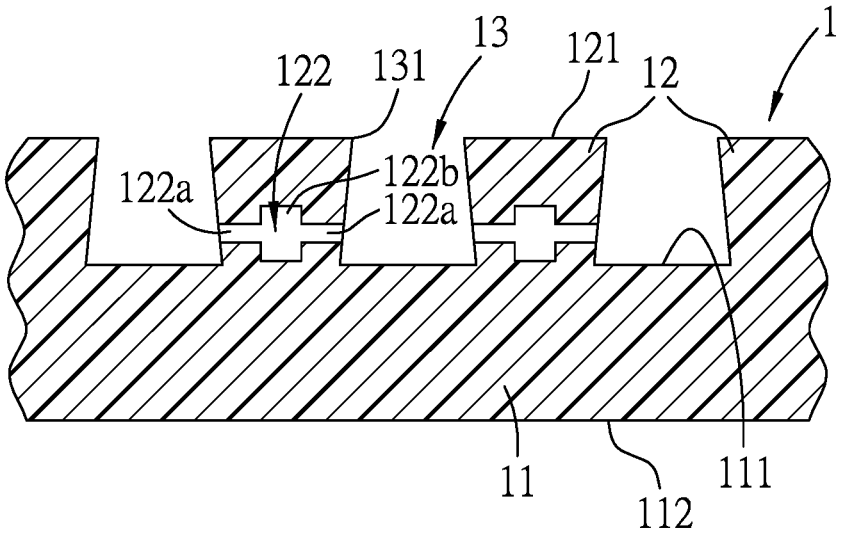
FIG. 2 is a fragmentary sectional view of a second embodiment of the chemical mechanical polishing pad according to the present disclosure.

Referring to FIG. 2, a second embodiment of the chemical mechanical polishing pad 1 according to the present disclosure has a structure similar to that of the first embodiment. The second embodiment further includes at least one tunnel 122 spatially intercommunicating two adjacent ones of the trenches 13 of the polishing portion 12. The tunnel 122 facilitates uniform distribution of the slurry among the trenches 13. In certain embodiments, the tunnel 122 has two opposite end parts 122*a* and a middle part 122*b* disposed between the end parts 122*a*. The middle part 122*b* has a cross section that is perpendicular to the polishing surface 121 of the polishing portion 12 and that has an area larger than that of each of the end parts 122*a* such that the debris may tend to be trapped in the middle part 122*b* of the tunnel 122. The number of the tunnel 122 may be more than one, and distribution of the tunnels 122 may be changed according to practical requirements. Two of the tunnels 122 are shown in FIG. 2.

Figure 3:
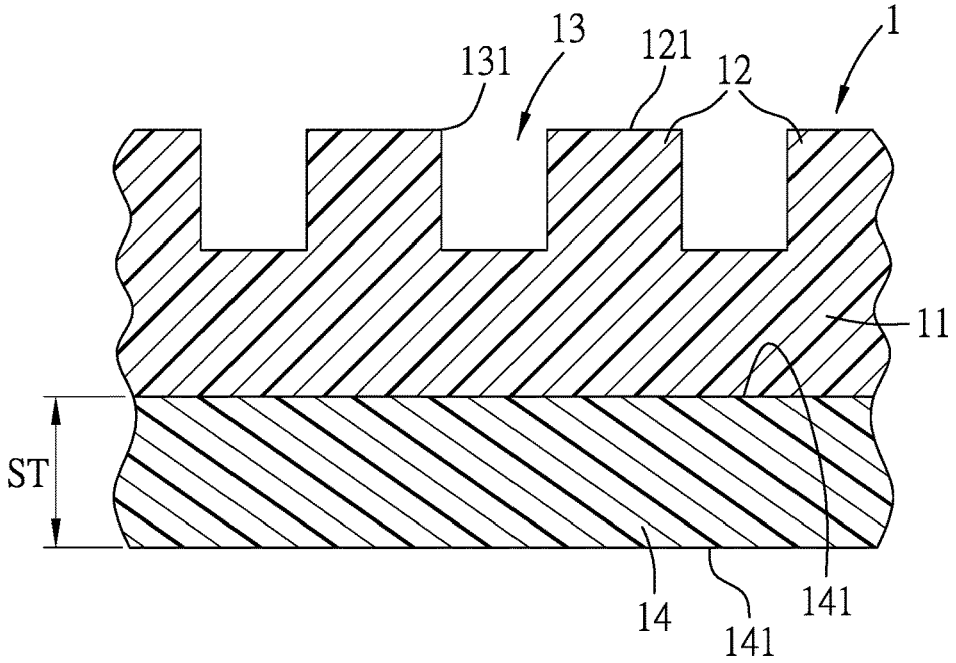
FIG. 3 is a fragmentary sectional view of a third embodiment of the chemical mechanical polishing pad according to the present disclosure.

Referring to FIG. 3, a third embodiment of the chemical mechanical polishing pad 1 according to the present disclosure has a structure similar to that of the first embodiment. In the third embodiment, the horizontal width (TW) of the opening 131 of each of the trenches 13 is equal to that of the remaining portion of the trench 13. The third embodiment further includes a support layer 14 that has two opposite side surfaces 141, one of which is attached to the second side surface 112 of the base portion 11. The support layer 14 has a density different from that of the base portion 11. When the density of the support layer 14 is smaller than that of the base portion 11 (i.e., the support layer 14 is softer than the base portion 11), the support layer 14 serves as a buffer layer during the polishing process and increases the efficiency of planarization. When the density of the support layer 14 is greater than that of the base portion 11 (i.e., the support layer 14 is harder than the base portion 11), the removal rate during the polishing process is increased.

Figure 4:
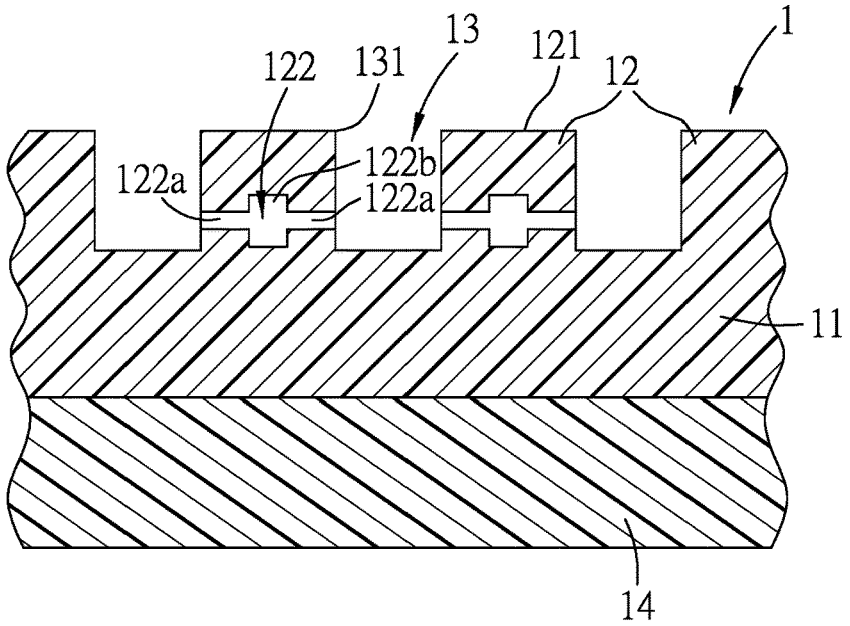
FIG. 4 is a fragmentary sectional view of a fourth embodiment of the chemical mechanical polishing pad according to the present disclosure.

Referring to FIG. 4, a fourth embodiment of the chemical mechanical polishing pad 1 according to the present disclosure has a structure similar to that of the third embodiment with the difference resides in that the fourth embodiment further includes a plurality of the tunnels 122.

The present disclosure also provides a method for manufacturing the chemical mechanical polishing pad 1. The method includes laminating a plurality of polymer layers by additive manufacturing technique, which may be selected from one of the techniques of fused deposition modeling (FDM), stereolithography (SL), selective laser sintering (SLS), etc. The polymer layers may be made of polymer materials that are mixed with organic or inorganic filler, polymer blend or copolymer. The polymer materials may be thermoplastic or thermosetting. In certain embodiments, the polymer layers may be made of a material selected from the group consisting of thermoplastic polyurethane (TPU), nylon, polyester, polycarbonate (PC) and polymethylmethacrylate (PMMA). The support layer 14 may also be manufactured by additive manufacturing technique. In a method of manufacturing the third embodiment, the support layer 14 is first laminated, followed by sequentially laminating the base portion 11 and the polishing portion 12.

In summary, the tapering design of the trenches 13 allows the trenches 13 to accommodate more slurry to increase polishing efficiency of the chemical mechanical polishing pad 1. Furthermore, since the horizontal width (TW) of the opening 131 of each of the trenches 13 is smaller than that of the remaining portion of the trench 13, debris generated during the polishing process is more likely to be retained in the trenches 13, thereby reducing the possibility of wafer scratch. Further, the tunnel 122 spatially intercommunicates two adjacent ones of the trenches 13 to facilitate uniform distribution of the slurry among the trenches 13. Besides, the area of the cross section of the middle part 122*b* is larger than that of each of the end parts 122*a* so that the debris may tend to be trapped in the middle part 122*b* of the tunnel 122, thereby also reducing the possibility of wafer scratch.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment, " "an embodiment, " an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A chemical mechanical polishing pad comprising:

a base portion that has opposite first and second side surfaces;

a polishing portion that extends from said first side surface of said base portion away from said second side surface, that has a polishing surface facing away from said base portion, and that has a plurality of trenches formed in said polishing surface, each of said trenches having an opening defined by said polishing surface of said polishing portion, a horizontal width of said opening of each of said trenches being equal to or smaller than that of the remaining portion of said trench; and at least one tunnel that spatially intercommunicates two adjacent ones of said trenches.

2. The chemical mechanical polishing pad as claimed in claim 1, wherein at least one of said trenches terminates at said first side surface of said base portion, and is tapered from said first side surface of said base portion to said polishing surface of said polishing portion.

3. The chemical mechanical polishing pad as claimed in claim 1, wherein said tunnel has two opposite end parts and a middle part disposed between said end parts, said middle part having a cross section that is perpendicular to said polishing surface of said polishing portion and that has an area larger than that of each of said end parts.

4. The chemical mechanical polishing pad as claimed in claim 1, wherein at least one of said trenches terminates at said first side surface of said base portion, and is tapered from said first side surface of said base portion to said polishing surface of said polishing portion.

5. The chemical mechanical polishing pad as claimed in claim 1, further comprising a support layer that has two opposite side surfaces, one of which is attached to said second side surface of said base portion, said support layer having a density different from that of said base portion.

6. A method for manufacturing the chemical mechanical polishing pad of claim 1, comprising laminating a plurality of polymer layers by additive manufacturing technique.

* * * * *